US011346079B2

(12) United States Patent
Christofferson et al.

(10) Patent No.: US 11,346,079 B2
(45) Date of Patent: May 31, 2022

(54) AUTOMATED CIRCLE ROTATE WITH PRESET ANGLE

(71) Applicant: DEERE & COMPANY, Moline, IL (US)

(72) Inventors: Craig Christofferson, Dubuque, IA (US); David A. Veasy, Dubuque, IA (US); Nathan J. Horstman, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 801 days.

(21) Appl. No.: 16/161,489

(22) Filed: Oct. 16, 2018

(65) Prior Publication Data

US 2020/0115884 A1 Apr. 16, 2020

(51) Int. Cl.
*E02F 3/84* (2006.01)
*E02F 3/76* (2006.01)

(52) U.S. Cl.
CPC ..... *E02F 3/845* (2013.01); *E02F 3/7636* (2013.01); *E02F 3/841* (2013.01)

(58) Field of Classification Search
CPC ..... E02F 3/845; E02F 3/7636; E02F 3/841
USPC ..... 172/795
See application file for complete search history.

(56) References Cited

U.S. PATENT DOCUMENTS 6,028,524 A 2/2000 Hartman et al.
6,278,955 B1 8/2001 Hartman et al.
6,286,606 B1 * 9/2001 Krieg et al. ..... E02F 3/764 172/4.5
7,458,428 B2 * 12/2008 Laudick et al. ..... E02F 3/6481 172/1
7,647,983 B2 * 1/2010 Gharsalli ..... E02F 3/765 172/793
7,676,967 B2 3/2010 Gharsalli et al.
7,874,377 B1 1/2011 Graeve
2002/0166267 A1 11/2002 McCugan
2008/0263912 A1 10/2008 Gharsalli et al.
2016/0153166 A1 * 6/2016 Gentle et al. ..... E02F 9/2012 172/781
2017/0101762 A1 4/2017 Chaston et al.
2017/0114523 A1 4/2017 Horstman et al.
2017/0342684 A1 11/2017 Sherlock
2018/0106014 A1 4/2018 Horstman et al.

FOREIGN PATENT DOCUMENTS

DE 19982943 T1 8/2001

OTHER PUBLICATIONS

German Search Report issued in counterpart application No. 102019214675.9 dated Jul. 17, 2020 (10 pages).

* cited by examiner

*Primary Examiner* — Thomas B Will
*Assistant Examiner* — Joel F. Mitchell
(74) *Attorney, Agent, or Firm* — Taft Stettinius & Hollister LLP; Stephen F. Rost

(57) ABSTRACT

A work machine that has a blade that is positionable at a plurality of angles relative to the work machine, a positioning system coupled to the blade to transition the blade to any one of the plurality of angles, a user interface providing a user input, and a controller in communication with the positioning system and the user input. Wherein, when the controller receives a first user input signal from the user interface, the controller positions the blade in a first preset position with the positioning system.

20 Claims, 5 Drawing Sheets

AUTOMATED CIRCLE ROTATE WITH PRESET ANGLE

FIELD OF THE DISCLOSURE

The present disclosure relates to an automatic circle rotate function for a motor grader, and more specifically to establishing preset positions of a blade of the motor grader.

BACKGROUND OF THE DISCLOSURE

Many work machines, such as motor graders, utilize cyclic passes over an underlying surface to redistribute or reposition material thereon. The operator often positions a blade or the like in a particular orientation prior to making the pass in order to move the material to the desired location. Motor graders frequently travel along S-like patterns from a start side of a work plane towards an end side of the work plane to properly grade the work plane. As the motor grader travels along the S-like pattern, it is frequently beneficial to continually push unneeded material from the start side towards the end side during each pass. Accordingly, the operator often runs a pass pushing material to the right side of the motor grader and then turns the motor grader around and runs an adjacent pass pushing material to the left side of the machine. Accordingly, after each pass the operator must reorient a blade of the motor grader to continue to push material towards the end side during the subsequent pass.

Traditional motor graders allow the operator to observe or otherwise control the angular orientation of the blade. The operator frequently selects an angle for the blade prior to initiating a pass based on the amount of material to be moved or other surface conditions. Then the operator drives the blade over the underlying surface to leave a top surface that has the ideal grade for that particular project. As the operator continues on the pass, the operator often changes the angle of the blade in order to accommodate more or less material that is being moved along the surface of the blade.

Once the operator finishes a pass, the operator raises the blade and turns the motor grader 180 degrees in preparation for a subsequent pass. Next, the operator often sets the blade to an offset angle that is substantially a mirrored angle of the start of the previous pass. Often, manipulating the position and angle of the blade requires the user to input multiple different commands to both raise and lower the blade and to select the angular orientation of the blade. Accordingly, at each turn the user sets the blade angle and orientation.

SUMMARY

One embodiment is a work machine that has a blade that is positionable at a plurality of angles relative to the work machine, a positioning system coupled to the blade to transition the blade to any one of the plurality of angles, a user interface providing a user input, and a controller in communication with the positioning system and the user input. Wherein, when the controller receives a first user input signal from the user interface, the controller positions the blade in a first preset position with the positioning system.

In one example of this embodiment, the positioning system comprises a circle rotate sensor that communicates with the controller to identify a current angle of the blade relative to the work machine.

In another example of this disclosure, the user interface selectably provides a second user input signal to the controller and the controller positions the blade in a second preset position with the positioning system responsive to the second user input signal. In one aspect of this example, the first preset position angle angles the blade to a first side of the work machine and the second preset position angle angles the blade to a second side of the work machine. In another aspect of this example, the first preset position angle and the second preset position angle are substantially mirrored angles about a longitudinal axis of the work machine. In a different aspect of this example, the user input is a roller having a first direction and a second direction and moving the roller twice in the first direction sends the first user input signal and moving the roller twice in the second direction sends the second user input signal.

In yet another example, the controller monitors other sensors of the work machine to identify a conflict before the controller moves the blade to the first preset position. In one aspect of this example, the controller issues a warning when the controller identifies a conflict. In another aspect of this example, the controller does not position the blade in a first preset position with the positioning system if the controller identifies a conflict.

Another embodiment of the present disclosure is a method for controlling the blade position of a work machine, the method including providing a controller, a blade movably coupled to the work machine, a user interface, and a positioning system coupled to the blade to reposition the blade relative to the work machine, storing in the controller, a first preset position of the positioning system, identifying, with the controller through the user interface, a first input signal when the user interface is engaged, positioning the blade, with the controller through the positioning system, to the first preset position when the controller identifies the first input signal.

In one example of this embodiment, the controller monitors one or more position sensor of the positioning system to identify a current angle of the blade, wherein, the controller repositions the blade until the current angle is a first preset angle of the first preset position.

Another example of this embodiment includes identifying a second input signal with the controller through the user interface and positioning the blade, with the controller through the positioning system, to a second preset position when the controller identifies the second input signal. In one aspect of this example the first input signal is a double button press of the user interface in a first direction over a time threshold and the second input signal is a double button press of the user interface in a second direction over the time threshold. In one aspect of this example, the first preset position and the second preset position are selectable by the user from a plurality of preset position options through the user interface. In another aspect of this example, the first preset position biases the blade to move underlying debris to a first side of the work machine and the second preset position biases the blade to move underlying debris to a second side of the work machine.

In another example of this embodiment, the controller monitors other sensors and establishes a maximum first preset position based on the other sensors.

Yet another embodiment of the present disclosure is a motor grader system that has a rear frame section, a front frame section coupled to the rear frame section, an engine coupled to the rear frame section, a circle rotate assembly coupled to the front frame section, a blade rotationally coupled to the circle rotate assembly to selectively alter a blade angle relative to a longitudinal axis, a user interface having one or more user input options, and a controller in communication with the circle rotate assembly to alter the blade angle responsive to a user input. Wherein, one of the user input options is a first input that correlates with a first preset blade angle and the controller positions the blade angle to be the first preset blade angle responsive to the first input.

In one example of this embodiment, one of the user input options is a second input that correlates with a second preset blade angle and the controller positions the blade angle to be the second preset blade angle responsive to the second input. One aspect of this example includes one or more wheel coupled to each of the front frame section and the rear frame section, wherein the controller monitors other sensors of the motor grader system to identify the position of the rear frame section and any wheel coupled thereto relative to the front frame section and does not allow the first preset blade angle or the second preset blade angle to be a blade angle that would cause contact between the blade and the front or rear frame sections or the one or more wheel coupled thereto.

In another example of this embodiment a circle rotate sensor is monitored by the controller to identify the blade angle.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
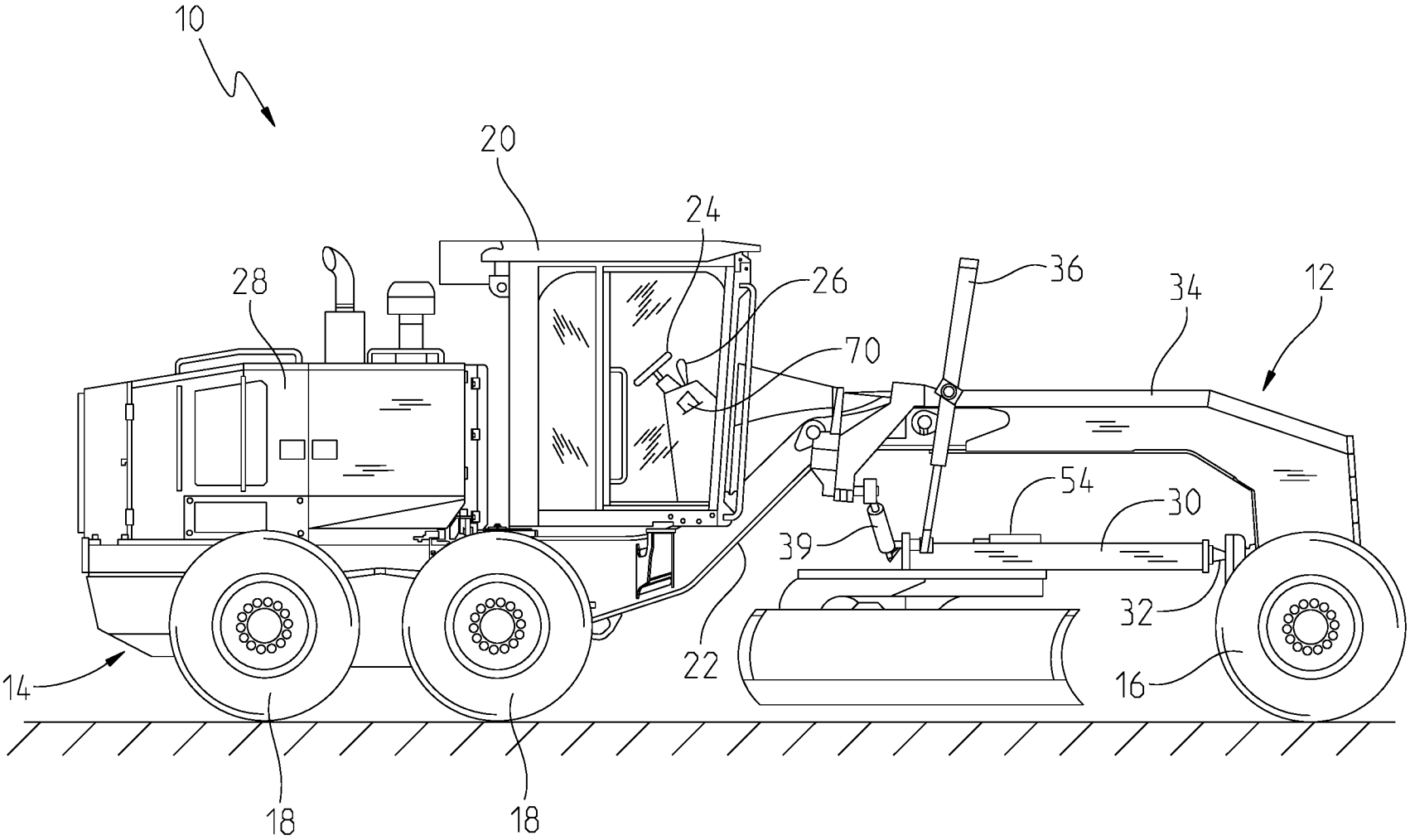
FIG. 1 is a right side view of a motor grader traveling toward the right with the blade angled for moving engaged material to the right.
Figure 2:
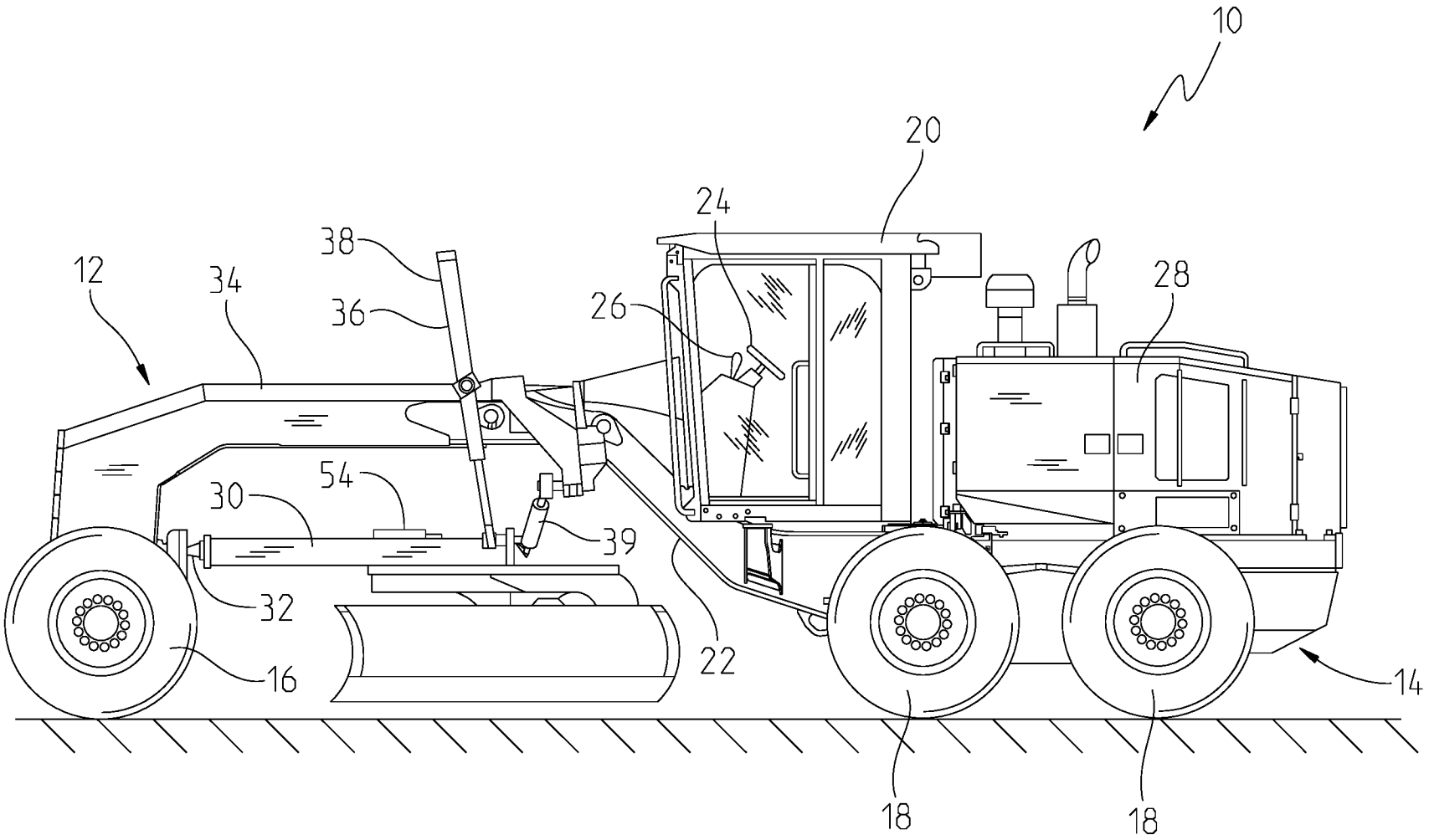
FIG. 2 is a left side view of a motor grader traveling toward the left with the blade angled for moving engaged material to the left.

Referring to FIGS. 1 and 2, there is shown a motor grader 10 including front and rear frames 12 and 14, respectively, with the front frame being supported on a pair of front wheels 16, and with the rear frame being supported on right and left tandem sets of rear wheels 18. An operator cab 20 is mounted on an upwardly and forwardly inclined rear region 22 of the front frame 12 and contains various controls for the motor grader disposed so as to be within the reach of a seated or standing operator. These controls including a steering wheel 24, a lever assembly 26, and a user interface 70 to name a few. An engine 28 is mounted on the rear frame 14 and supplies the driving power for all driven components of the motor grader. For example, the engine 28 is coupled for driving a transmission coupled to the rear wheels 18 at various selected speeds and either in forward or reverse modes. A hydrostatic front wheel assist transmission may be selectively engaged to power the front wheels 16, in a manner well known in the art. Further, the engine 28 may be coupled to a pump or a generator to provide hydraulic, pneumatic, or electrical power to the motor grader 10 as is known in the art.

Mounted to a front location of the front frame 12 is a drawbar 30, having a forward end universally connected to the front frame by a ball and socket arrangement 32 and having opposite right and left rear regions suspended from an elevated frame section 34 of the main frame 12 by right and left lift linkage arrangements including right and left extensible and retractable hydraulic actuators 36 and 38, respectively. A side shift linkage arrangement is coupled between the elevated frame section 34 and a rear location of the drawbar 30 and includes an extensible and retractable side swing hydraulic actuator 39.

The right, left, and side swing hydraulic actuators 36, 38, 39 may be repositionable to alter a cross slope of a moldboard or blade 46. The cross slope may be the angle of the blade 46 relative to the underlying surface. More specifically, the wheels 16, 18 of the motor grader 10 may rest on the underlying surface to establish a surface plane. The actuators 36, 38, 39 may be selectively resized to pivot the blade 46 about the ball and socket arrangement 32 to thereby change the angular orientation of the blade 46 relative to the underlying surface or surface plane. For example, the actuators 36, 38, 39 may have a neutral position wherein the actuators 36, 38 are sized to ensure the blade 46 is substantially parallel with the underlying surface. Alternatively, the actuators 36, 38, 39 may have a cross slope orientation where the actuators 36, 38, 39 are sized to angularly offset the blade 46 relative to the underlying surface. The cross slope of the blade 46 may be biased towards either side of the motor grader as is known in the art.

Figure 3:
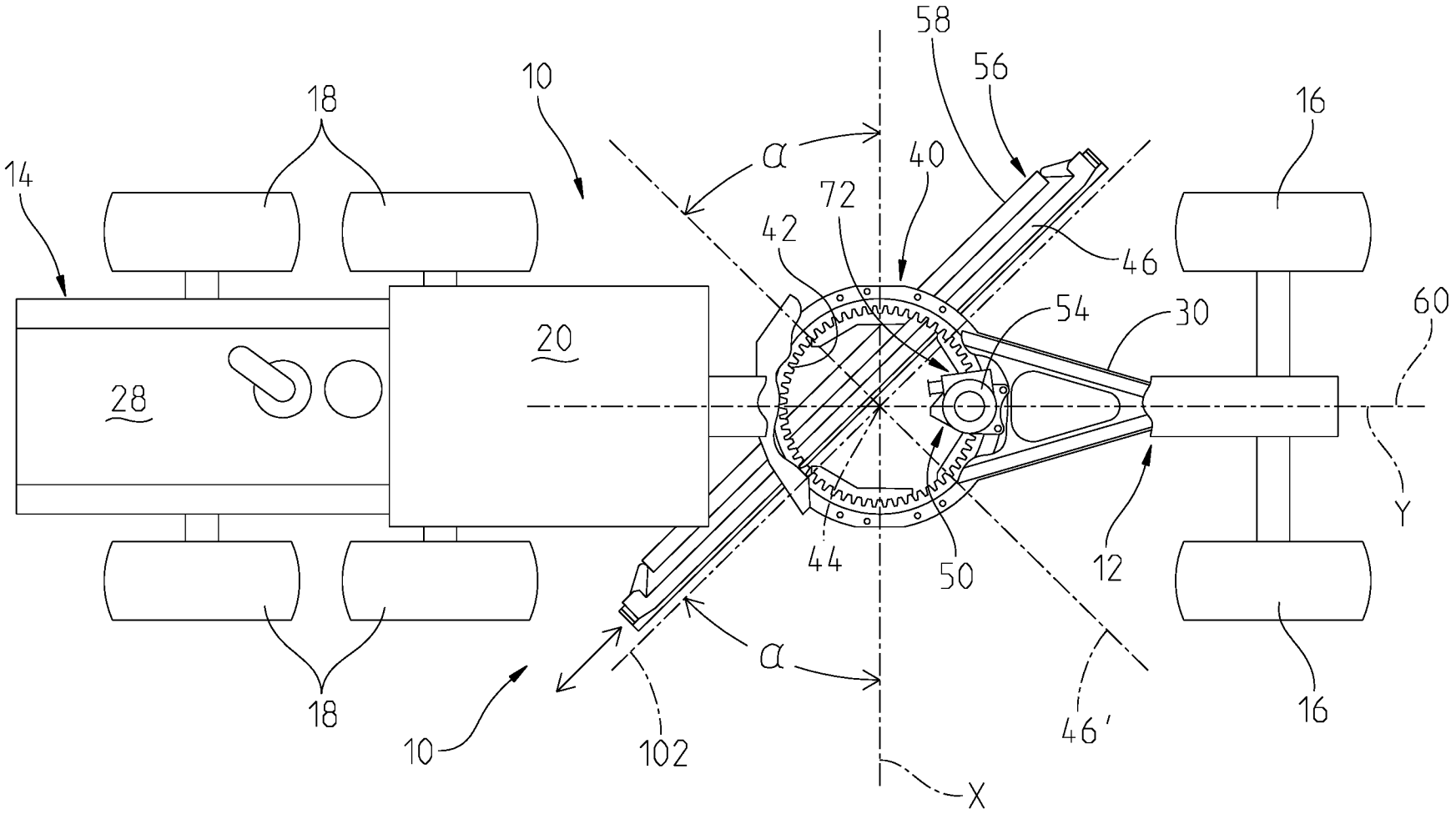
FIG. 3 is a schematic top view of the motor grader with parts broken way showing the drawbar and circle frame with the blade being shown in mirror image positions respectively corresponding the those shown in FIGS. 1 and 2.

Referring now to FIG. 3, the blade 46 may also be mounted on a side shift assembly 56 to slideably move between a first side and a second side. More specifically, a hydraulic side shift actuator 58 interconnects a tilt frame and the side shift assembly 56 and is operable to side shift the blade 46 relative to a longitudinal axis 60 of the motor grader 10. Further, the side shift actuator 58 may selectively slide the blade 46 along the side shift assembly 56 to be biased towards different sides of the longitudinal axis 60 as desired by the user.

It can be seen that a circle 40, which defines a large internal annular gear, indicated by broken lines 42, is mounted to a rear region of the drawbar 30 for rotation about an upright central axis 44 of the annular gear 42 in a manner well known in the art. The elongated blade 46 extends parallel to, and beneath a planar lower surface of the annular gear 42 of the circle 40 and is fixed to the circle so that, when the circle rotates about the axis 44, an angle $\alpha$ the blade 46 makes relative to a line X extending perpendicular to a direction of travel Y is adjusted. The blade 46 is illustrated in a position corresponding to that illustrated in FIG. 1 wherein debris engaged by the blade will slide rightward along a front face of the blade and will be deposited outside the track of the right set of tandem rear wheels 18. When the motor grader 10 is operating in the opposite direction, corresponding to that shown in FIG. 2, the blade 46 is rotated clockwise into a position 46' which is substantially a mirror image of that shown in FIGS. 1 and 3.

Provided for selectively adjusting the circle 40 angularly about the axis 44 is a circle drive 50 mounted to the drawbar 30 and including a gear having teeth meshed with the teeth of the internal annular gear 42. A variable displacement circle drive motor 54 has an output shaft coupled directly to the gear of the circle drive 50. While a specific circle drive 50 is illustrated and described herein, this disclosure considers using any known drive assembly for the circle drive 50.

Accordingly, in the non-exclusive example of a motor grader 10 shown and described herein, the circle drive 50 may alter the angular position of the blade 46 relative to the longitudinal axis 60, the hydraulic actuators 36, 38, 39 may be repositionable to alter the cross slope of the blade 46 relative to the underlying surface, and the side shift actuator 58 may slide the blade 46 to be biased towards one side or the other of the motor grader 10. While several of the adjustable functions of the motor grader 10 have been discussed herein, the teachings of this disclosure can be applied to any adjustable component of a motor grader. Accordingly, this disclosure contemplates manipulating any adjustable features of a motor grader known in the art.

Figure 4:
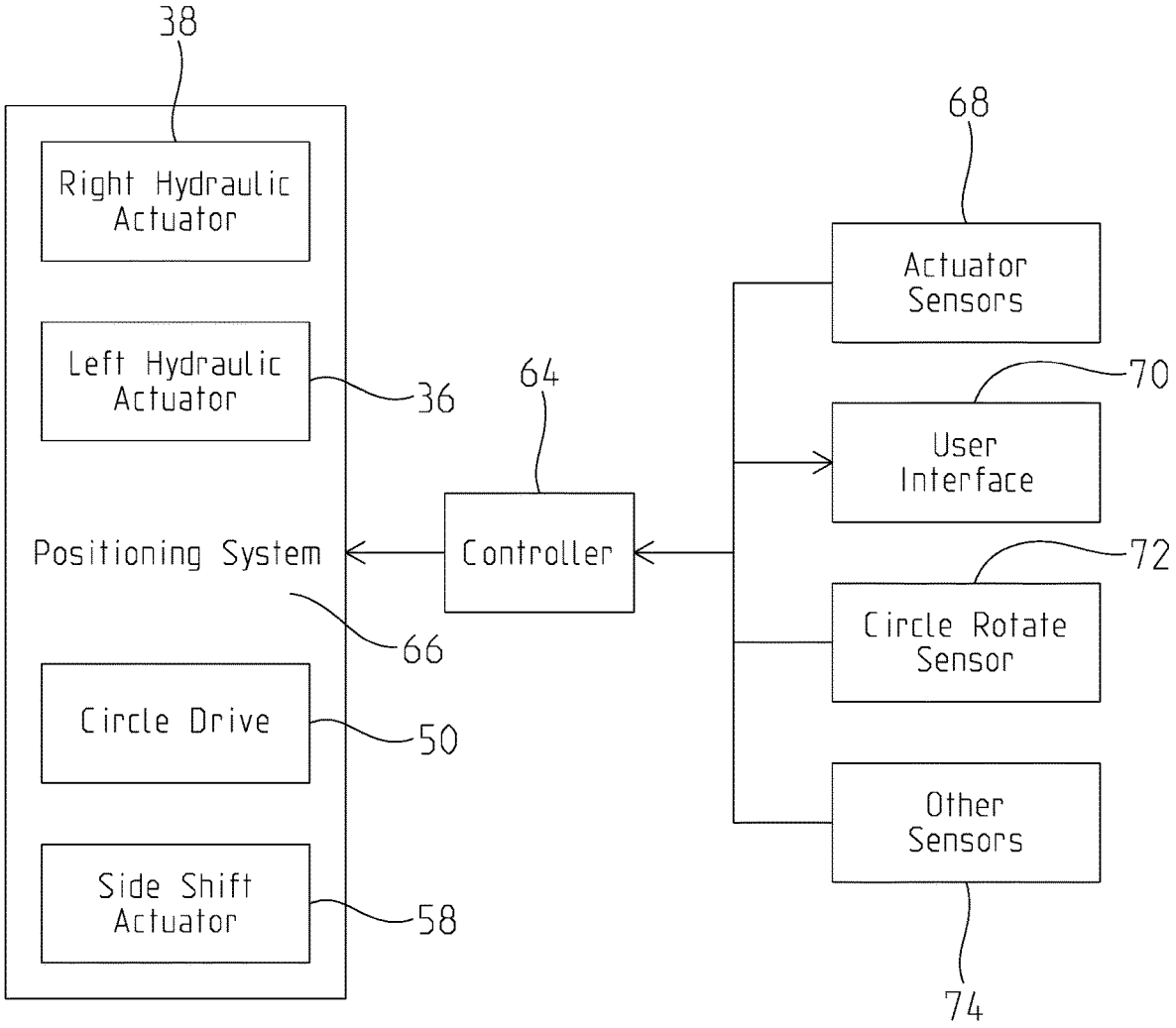
FIG. 4 is a schematic view of some of the components of the motor grader of FIG. 1.

Referring now to FIG. 4, a schematic view of some of the components of a control system are shown. The control system may have a controller 64 that communicates with the many different systems of the motor grader 10. The controller 64 may have a memory unit for storing data and a processor for executing commands and the like. In one embodiment, the controller 64 is one or more controller of the motor grader 10. Further, the controller 64 may have a memory unit that is separate from the processor. Further still, in one embodiment the controller 64 is located remotely from the motor grader 10 and communicates with the components of the motor grader via known wireless protocols. Accordingly, the controller 64 described herein can be any electronic device or devices capable of executing commands with the components of the motor grader 10.

In one aspect of this disclosure, the controller 64 may communicate with a positioning system 66 of the motor grader 10 to reposition the blade 46 as described herein. The positioning system 66 may include any one or more of the right hydraulic actuator 38, the left hydraulic actuator 36, the side swing hydraulic actuator 39, the circle drive 50, and the side shift actuator 58. Further, the positioning system 66 may utilize hydraulic, pneumatic, or electric actuators and motors to reposition the blade 46.

In one non-exclusive example, the positioning system 66 utilizes an electro hydraulic system that is controlled by the controller 64. More specifically, the controller 64 may utilize electrical solenoids or the like to open and close hydraulic valves to direct fluid from a hydraulic pump to corresponding actuators or motor to thereby reposition the blade 46.

Alternatively, the positioning system 66 may be an electro pneumatic system that functions similarly to the electrohydraulic system described above. Further still, in yet another embodiment the positioning system 66 is an entirely electrical system that obtains power from batteries on the motor grader 10 or through a generator that converts mechanical energy to electrical power. Accordingly, this disclosure contemplates utilizing any known positioning system 66 that can implement instructions from the controller 64 including at electro hydraulic systems, electro pneumatic systems, and electrical systems to name a few.

In one aspect of this disclosure, the position of the blade 46 may be determined utilizing one or more sensor configured to identify the position of components of the positioning system 66. For example, actuator sensors 68 may be coupled to the left and right hydraulic actuators 36, 38 and the side swing hydraulic actuator 39 to identify to the controller 64 the linear displacement of the corresponding actuator. In this example, the actuator sensors 68 may be monitored by the controller 64 to identify the cross slope of the blade 46. More specifically, the controller 64 can monitor the linear displacement of the left and right actuator 36, 38 and side swing hydraulic actuator 39 to determine the cross slope of the blade 46 based on the linear displacement of the actuators 36, 38, 39 and known geometries of the motor grader 10 stored in the controller 64.

A circle rotate sensor 72 may also communicate with the controller 64 to identify the angle $\alpha$ of the blade 46. The circle rotate sensor 72 may be positioned to identify the angular position of the annular gear 42 relative to the circle 40 and in turn the angular position of the blade 46. Accordingly, the circle rotate sensor 72 may substantially constantly communicate the angle $\alpha$ of the blade 46 to the controller 64. Further, the controller 64 can modify the angle $\alpha$ by manipulating the circle drive 50 to thereby rotate the blade 46. Accordingly, the controller 64 can both monitor the angular position of the blade 46 with the circle rotate sensor 72 and alter the angular position of the blade 46 with the circle drive 50. In one non-limiting example, the circle rotate sensor 72 may be a linkage connected to the annular gear that communicates the angular position of the blade 46 to the controller.

The controller 64 may also communicate with any other sensors 74 of the motor grader 10 to identify the position of the blade 46 or other vehicle conditions. For example, one of the other sensors 74 may be a camera that visually monitors the blade 46. The controller 64 may analyze the images provided by the camera to determine the angle of the blade 46 among other things. Accordingly, this disclosure contemplates utilizing any known sensor of the motor grader 10 to implement the teachings explained herein. The sensors described herein may be any type of sensor known in the art and intended to execute the described measurement. More specifically, at least Hall Effect sensors, potentiometers, rotary encoders, encoded cylinders, and the like are considered herein.

In another aspect of this disclosure, the user interface 70 communicates with the controller 64. The user interface 70 may be a plurality of buttons or other inputs including a roller or joystick that may be pushed to a first side and a second side. For example, the user interface may be, in part, a roller or joystick that may be manipulated by the user as a circle rotate command. The user may engage the roller or joystick in a first direction to rotate the blade in a first direction or engage the roller or joystick in a second direction to rotate the blade in a second direction.

Further, the user interface 70 may be a touchscreen or the like that allows the user to selectively provide inputs via the touchscreen. Further still, the user interface 70 could utilize voice commands to communicate the user's desires with the controller 64. In yet another non-exclusive example, the user interface 70 may be a remote user interface such as a tablet, smartphone, laptop, or the like that can remotely communicate with the controller 64. Accordingly, any known user interface 70 is considered herein and the teachings of this disclosure can be implemented using many different types of a user interface.

Figure 5:
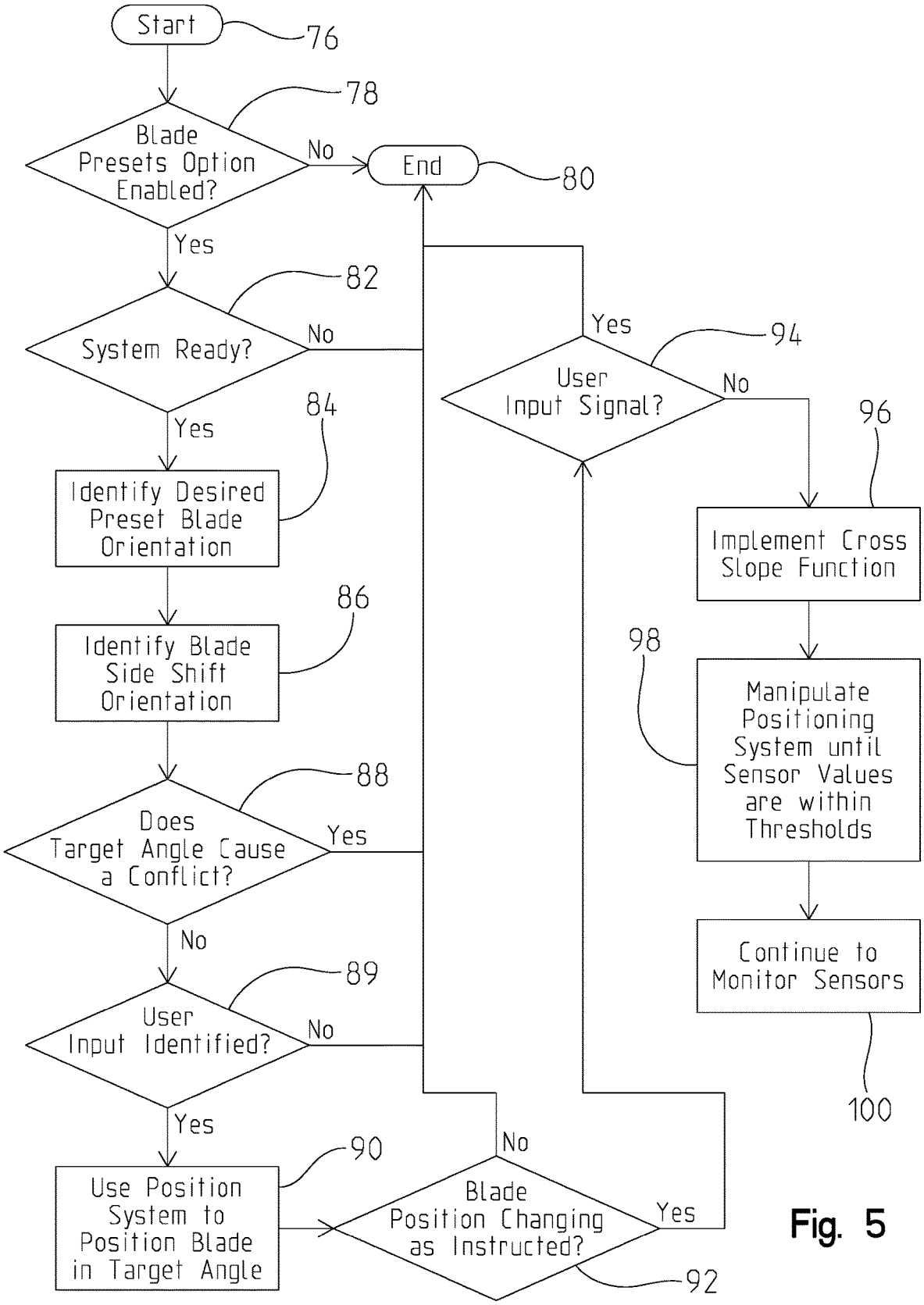
FIG. 5 is a logic flow chart of one embodiment of a logic system implemented by a controller.

Referring now to FIG. 5, one non-exclusive example of a logic flow chart for establishing a first and second blade position preset is illustrated. The logic flow chart of FIG. 5 utilizes the positioning system 66 of the motor grader 10 to establish and set a first preset blade position when the motor grader 10 is travelling in a first direction and a second preset blade position when the motor grader 10 is travelling in a second direction. In one non-exclusive example, the logic flow chart of FIG. 5 may be implemented when a user is grading an underlying surface in the S-like pattern explained above. In this scenario, the user may want to move debris from the underlying surface from a start side of the underlying surface to an end side of the underlying surface. The user may implement passes along the underlying surface in alternating directions, thereby requiring the user to alter the blade angle and position during each pass to ensure that debris is properly directed towards the end side during each pass.

The user frequently desires to start each pass with the blade 46 in substantially the same orientation, but may alter the angle of the blade 46 during the pass to address moving more or less debris along the underlying surface. Once the user completes a pass, they may raise the blade 46 and execute a substantially 180 degree turn in preparation for a subsequent pass in the opposite direction. Prior to executing the subsequent pass, the user may want to return the blade 46 to a position substantially opposite of the position of the blade 46 during the start of the initial pass. One aspect of this disclosure allows the user to manipulate the blade angle and position throughout the pass, while returning the blade to a preset orientation during the start of the subsequent pass.

The logic system of FIG. 5 allows the user to establish a first preset blade orientation for starting a pass in the first direction and a second preset blade orientation for starting a pass in the second direction. In one aspect of this disclosure, the second preset blade orientation may be substantially the opposite of the first preset blade orientation about the longitudinal axis 60. For example, if the user desires a first preset blade angle $\alpha$ towards a right side of the motor grader 10, the second preset blade angle $\alpha$ may be angled towards the left side of the motor grader 10 to the same degree albeit towards the opposite side of the longitudinal axis 60. Similarly, the cross slope orientation of the second preset blade orientation may be substantially the opposite of the cross slope of the first preset blade orientation. Further still, the side shift spacing of the second preset may bias the blade 46 to substantially the opposite side of the longitudinal axis 60 compared to the first preset. Accordingly, one aspect of this disclosure is to provide the user with selectable presets that can orient the blade 46 in any desired orientation as the user transitions from travelling between the first direction and the second direction.

The logic flow chart of FIG. 5 may initially be executed by the controller 64 at the start box 76. The start box 76 may be implemented when the electrical system of the motor grader 10 is engaged such as when the motor grader 10 is in a run state or the like. Once the start condition of box 76 is met, the controller 64 may identify whether a blade presets option is enabled in box 78. The blade presets option may be enabled and disabled via the user interface 70. For example, the user interface 70 may be a touch screen that has a selection identified as "Blade Presets" and have a user selectable button that toggles between "On" and "Off" on the touch screen. Alternatively, a physical toggle switch may be in the operator cab 20 and labelled as "Blade Presets" and have an "On" and an "Off" position. Further, any known method of enabling an option is considered in box 78, and this disclosure considers implementing any reasonable method.

If the blade presets option is not enabled in box 78, the controller 64 may simply end the inquiry in box 80. While box 80 is shown and labelled as an end operation, box 80 may also be a return to box 76 wherein the controller 64 continues to monitor the start condition of box 76 and the blade presets option of box 78. Accordingly, in one embodiment of this disclosure the controller 64 may be substantially continuously executing the control logic of FIG. 5.

If the blade presets option of box 78 is enabled, the controller 64 may run a systems check in box 82. The systems check of box 82 may include the controller 64 monitoring whether the hydraulic system of the motor grader 10 is enabled, whether the user interface 70 is indicating any error signals or disabled, whether the circle rotate sensor 72 is identifying a valid circle rotate angle, whether the engine 28 is running, whether there are any faults identified in the electro hydraulic system, whether a saddle pin is in a center position, whether a valid circle calibration has been performed, and the like.

The controller 64 may monitor any one or more of the above conditions and disable the logic flow chart of FIG. 5 if the controller 64 determines the condition is not properly met. For example, the controller 64 will execute the end command of box 80 after box 82 if the hydraulic system is disabled, there is an error signal from the user interface 70, the circle rotate sensor 72 is showing an invalid rotate angle, the engine 28 is not running, there is a fault in the electro hydraulic system, the saddle pin is not in the center position, or a valid circle calibration has not been performed within a preset time period.

While specific systems are described above with reference to box 82, any relevant system check is considered herein and the above examples are not meant to be exhaustive. Accordingly, the controller 64 may check any relevant system in box 82 that may affect the execution of the logic flow chart described herein.

If the controller 64 identifies that the system is ready after executing the system check of box 82, the controller 64 may communicate with the user interface 70 to identify the desired preset blade orientations in box 84. The desired preset blade orientations may include a first side circle rotate angle, first side cross slope angle, first side shift position, second side circle rotate angle, second side cross slope angle, and second side shift position to name a few. The user may input the desired preset blade orientation via the user interface 70 by inputting the specific angles they desire for each of the first and second circle rotate angles, the cross slope angles and the desired side shift distances for each of the first and second side shift positions. Alternatively, the user may input only the first circle rotate angle, cross slope angle, and side shift position and the controller 64 may automatically generate the second circle rotate angle, cross slope angle, and side shift position to be substantially the opposite thereof.

In one embodiment of this disclosure, instead of inputting each of the angles and distances above, the user may establish the desired blade orientation presets by selecting preset configurations with the user interface 70 during box 84. The preset configurations may have established circle rotate angles, cross slope angles, and side shift distances that are commonly used by motor graders 10 and the user may simply select one of the preset configurations to be the corresponding first or second desired preset blade orientation.

The user may establish a first side preset circle rotate angle, a first side preset cross slope angle, a first side preset side shift position, a second side preset circle rotate angle, a second side preset circle rotate angle, and a second side preset side shift position in box 84. Further, the established angles and positions may be stored in the memory unit of the controller 64. The first side preset circle rotate angle, the first side preset cross slope angle, and the first side preset side shift position may be stored under a first side preset and the second side preset circle rotate angle, the second side preset cross slope angle, and the second side preset side shift position may be stored under a second side preset. As will be described in more detail herein, the controller 64 may recall the first or second side preset angles and positions when instructed to via the user interface 70 and utilize the position system 66 to reposition the blade 46 in the corresponding preset orientation.

In box 86 the controller 64 may utilize the actuators sensors 68 or the other sensors 74 to identify the blade side shift orientation. More specifically, in one non-exclusive embodiment, the side shift actuator 58 may be an encoded cylinder that sends data to the controller 64 that indicates the linear displacement of the side shift actuator 58. In turn, the controller 64 may identify the position of the blade 46 along a blade axis 102. Alternatively, the controller 64 may utilize a camera or any other sensor to identify the location of the blade 46 along the blade axis 102. Accordingly, box 86 may utilize any known sensor for determining the blade side shift orientation and the above embodiments are meant as examples of such sensors.

After the controller 64 identifies the blade side shift orientation in box 86, the controller 64 may determine whether the desired preset blade orientation causes a conflict between the blade 46 and the wheels 16, 18 or frame sections 12, 14 of the motor grater 10 in box 88. In one non-exclusive example, the controller 64 may utilize a lookup table that is stored in the memory unit as part of box 88. The lookup table may classify the blade side shift location as being in a minimum, center, or maximum location. Each of the minimum, center, and maximum locations may correspond with a location range along the blade axis 102. For example, the center location may correspond with a blade location that is not shifted more than about a few inches away from a central position wherein a central portion of the blade 46 is positioned along the longitudinal axis 60. Further, the minimum blade side shift location may be identified by the controller 64 when the blade 46 is moved more than a few inches along the blade axis 102 towards the first side of the motor grader 10 and the maximum blade side shift location may be identified by the controller 64 when the blade 46 is moved more than a few inches along the blade axis 102 towards the second side of the motor grader 10.

In one non-exclusive example, the lookup table of box 88 may establish a maximum blade angle that corresponds with the blade side shift orientation determined in box 86. More specifically, if the blade side shift orientation is in the maximum or minimum location, the lookup table may establish a maximum blade angle that is less than when the blade side shift orientation is in the center location. Among other things, utilizing the lookup table in box 88 may ensure that the blade 46 does not damage the motor grader 10. If the blade side shift orientation is in the center location, the blade 46 may be able to rotate about the central axis 44 to a greater degree than when the blade shift orientation is in the minimum or maximum orientation. More specifically, when the blade shift orientation is in the maximum or minimum location, the blade may be oriented to contact the wheels 16, 18 or frame 12, 14 of the motor grader 10 when positioned at an angle that would not contact the wheels 16, 18 or frame 12, 14 in the central location.

While a lookup table is discussed herein, this disclosure considers implementing any known method of correlating blade side shift orientation values with available angular displacement of the blade 46 about the central axis 44. For example, the controller 64 may utilize a graph or an algorithm to determine whether the blade 46 will contact the motor grader 10 in the desired preset blade orientation identified in box 84. Accordingly, this disclosure considers using any known method for identifying the blade side shift orientation of the blade 46 prior to determining whether the blade side shift orientation causes a conflict when the blade is moved to the desired preset blade orientation.

Regardless of the method used to determine whether the desired preset blade orientation causes a conflict with the motor grader 10, if the controller 64 determines that the desired preset blade orientation does cause a conflict in box 88, the controller 64 may execute box 80 and end the logic flowchart of FIG. 5. Further in one embodiment of this disclosure the controller 64 may also display an error message on the user interface 70 if a conflict is determined. The error message may indicate the cause of the conflict, the available blade orientation, or any other information that may help the user identify the cause of the error. In one aspect of this disclosure, when the controller 64 identifies a conflict in box 88, the controller 64 may not move the blade orientation from the position that the blade 46 was in at the start of the logic flowchart.

In box 89, the controller 64 may monitor the user interface to identify when a first or second user input has been identified. The first user input may be indicative of a user's desire to position the blade 46 in the first desired preset blade orientation and the second user input may be indicative of the user's desire to position the blade 46 in the second desired preset blade orientation. As described above, the first user input may be identified by the controller 64 when the user rotates a roller in the first direction. More specifically, the controller 64 may monitor the roller and identify the first user input when the roller is moved in the first direction twice within a time threshold. Similarly, the controller may monitor the roller and identify the second user input when the roller is moved in the second direction twice within a time threshold.

While a particular type of user input is described herein, this disclosure considers utilizing any type of user input that can indicate the user's preference as either the first desired preset blade orientation of the second desired preset blade orientation. Accordingly, this disclosure also considers utilizing a touchscreen interface, push-button switches, voice control, and any other known user input method to allow the user to select either the first desired preset blade orientation or the second desired preset blade orientation established in box 84.

If the controller 64 identifies either the first user input or the second user input in box 89, and if the controller 64 does not identify a conflict in box 88, the controller 64 may utilize the positioning system 66 to position the blade 46 in the preset blade orientation that correlates with the user input of box 89 by executing box 90. In box 90, the controller 64 may utilize any one or more of the circle drive 50, the side shift actuator 58, the left hydraulic actuator 36, the right hydraulic actuator 38, or the side swing hydraulic actuator 39 to position the blade 46 into the desired preset blade orientation established in box 84. For example, if the first user input is identified in box 89, the controller 64 may begin to position the blade 46 in the first desired preset blade orientation. More specifically, the controller 64 may alter the blade angle $\alpha$ with the circle drive 50, the cross slope with the actuators 36, 38, 39 and the side shift location along the blade axis 102 with side shift actuator 58 towards the first desired preset blade orientation established in box 84.

Alternatively, if the second user input is identified in box 89, the controller 64 may begin to position the blade 46 in the second desired preset blade orientation. More specifically, the controller 64 may alter the blade angle α with the circle drive 50, the cross slope with the actuators 36, 38, 39 and the side shift location along the blade axis 102 with side shift actuator 58 towards the second desired preset blade orientation established in box 84. In other words, the controller 64 utilizes the positioning system 66 in box 90 to orient the blade 46 in either the first or second desired preset blade orientation established in box 84.

Referring now to boxes 92 and 94, the controller 64 may continue to monitor the blade position and user interface 70 as the positioning system 66 repositions the blade 46 into one of the first or second desired preset blade orientations. More specifically, in box 92 the controller 64 may monitor the movement of the blade 46 about the central axis 44 with the circle rotate sensor 72. If the controller 64 identifies that the blade 46 is not rotating about the central axis 44 as expected, the controller 64 may execute the end box 80 and stop providing commands to reposition the blade 46. The controller 64 may have a movement threshold stored therein such as an expected angular change in a given amount of time. The controller may compare the movement of the blade 46 to the movement threshold in box 92. If the movement of the blade does not meet the movement threshold, the controller 64 may assume the blade 46 that there is an issue with the positioning system 66 and stop instructing the positioning system 66 to move. However, if the blade 46 position is moving as expected, the controller 64 may continue to move the blade 46 to the selected desired preset blade orientation.

Similarly, in box 94 the controller 64 may continue to monitor the user interface 70 to determine whether a blade position command is received. The blade position command may be any command that requires the blade 46 to be repositioned with the positioning system 66. If the controller 64 identifies a blade position command in box 94, the controller 64 may assume the user wants to abort moving the blade 46 to the desired preset blade orientation and thereby execute box 80 and end the logic flow chart. However, if the controller 64 does not receive any inputs indicating the user desires to move the blade 46, the controller may continue to execute box 96.

In box 96, the controller 64 may identify whether a cross slope function has been enabled by the user. The cross slope function may be selected by the user through the user interface 70 and allow the user to decide whether the controller 64 should implement a modified cross slope value when executing the selected desired preset blade orientation from box 84. If the cross slope function is enabled, the controller 64 may utilize the positioning system 66 to ensure that the cross slope angle of the blade 46 is modified by the positioning system 66 to the modified cross slope value. More specifically, when the cross slope function is enabled in box 96, when the user selects the second user input, the controller 64 may mirror the cross slope angle of the blade 46 from the first user input orientation. However, if the controller 64 identifies that the cross slope function is disabled, the controller 64 may maintain the cross slope in a neutral position while it implements the selected desired preset blade orientation.

In box 98, the controller 64 may continue to manipulate the positioning system 66 while monitoring the sensors 68, 72, 74 until the blade 46 becomes located within the selected desired preset blade orientation. In one non-exclusive example of this disclosure, the controller 64 may establish threshold angles that correlate with the desired preset blade orientation. The controller 64 may manipulate the position of the blade 46 with the positioning system 66 until the sensors 68, 72, 74 indicate the blade 46 is orientated in a position that is within the threshold angles. In one non-exclusive embodiment, desired blade angle α established in box 84 may be 18 degrees. In this example, the threshold angles for the blade angle α may be plus and minus about 0.5 degrees of the desired preset blade orientation, or between about 17.5 degrees and 18.5 degrees. Further, in this example the controller 64 may manipulate the positioning system 66, and mainly the circle drive 50, until the blade angle α is between about 17.5 degrees and about 18.5 degrees.

The controller 64 may similarly establish cross slope angle thresholds if the cross slope function is enabled in box 96. Further still, the controller 64 may establish a side shift threshold as well in box 98. However, the side shift thresholds may be linear displacements along the blade axis 102 rather than angular orientations. In the side shift threshold example, the user selected value may be a distance offset to one side of the longitudinal axis 60 such as x inches. The controller 64 may automatically establish a side shift threshold of x−1 inch and x+1 inch and utilize the positioning system 66, and mainly the side shift actuator 58 in this particular example, to move the blade 46 towards the desired side shift position. Once the blade is offset by a distance between x−1 and x+1 inch, the controller 64 may maintain the position of the blade along the blade axis 102.

While particular examples of the threshold values and the like are discussed herein, this disclosure considers using many different threshold values depending on the capabilities of the hardware being used and the needs of the user. More specifically, if the user is executing a rough grading function with the motor grader 10, less precise blade positions may be required and the threshold values may provide a large range. Alternatively, when the user is executing a finish grading function with the motor grader 10, more precise blade positions may be required and the threshold values may provide a smaller range of acceptable orientations of the blade.

Regardless of the size of the thresholds established in box 98, the controller 64 may utilize the positioning system 66 to manipulate the blade position to be within the threshold values. That may include altering the circle rotate angle α with the circle drive 50, the side shift offset with the side shift actuator 58, and the cross slope angle with the actuators 36, 38, 39. Once the controller 64 determines that the blade orientation is within the threshold values, the controller 64 may execute box 100 and continue to monitor the sensors 68, 72, 74 of the motor grader 10 and ensure they indicate the blade 46 is remaining within the threshold ranges established in box 98.

While box 100 indicates the controller 64 continues to monitor the sensors 68, 72, 74, in another embodiment of this disclosure the controller 64 may not continue to monitor the sensors in box 100 but rather maintain the position of the blade 46 with the positioning system 66. In this embodiment, the controller 64 may not continuously monitor the sensor but rather maintain the blade 46 in the preset orientation once the controller 64 identifies the blade 46 is properly oriented therein.

While specific steps of the logic flow chart are explained in FIG. 5, other embodiments may include more or less steps than those specifically described herein. More specifically, in one embodiment at least boxes 82, 86, 88, 89, 92, 94, 96, and 100 can be omitted. In this example, box 78 may only allow the blade presets option to be enabled when the system is ready. In this configuration, box 78 may skip box 82 and execute box 84 immediately thereafter. Similarly, in this example the controller 64 may only allow the user to select desired preset blade orientations that do not conflict with the motor grader 10 regardless of the blade side shift orientation, and the controller 64 may execute box 90 after box 84. Further still boxes 92, 94, and 96 may be omitted and the controller 64 may execute box 98 after box 90.

Further, while the logic flow chart of FIG. 5 illustrates the controller 64 executing the logic in a particular order, other embodiments may execute all of the steps described therein repeatedly or at the same time. In this embodiment, the controller 64 may be continuously monitoring the sensor 68, 72, 74 and the user interface 70 to determine both the current orientation of the blade 46 and the desired orientation of the blade 46 among other things. Accordingly, this disclosure considers executing the logic flow chart of FIG. 5 simultaneously and in a different order than that specifically illustrated.

In one non limiting example applying the teachings of this disclosure, a user may enter the operator cab 20 of the motor grader 10. The user may be positioned to manipulate the user interface 70, which includes a circle rotate position roller that can be manipulated in a first direction to rotate the blade 46 in a first direction and in a second direction to rotate the blade 46 in a second direction. The user may start the motor grader 10 and engage the blade presets option via the user interface 70. If the controller 64 identifies that the system is ready, the user may be provided an option to set a first desired preset blade orientation and a second desired preset blade orientation via the user interface 70.

The first desired preset blade orientation may include a first circle rotate angle, a first cross slope angle, and a first side shift offset distance all selectably input by the user via the user interface 70. Similarly, the second desired preset blade orientation may include a second circle rotate angle, a second cross slope angle, and a second side shift offset distance all selectably input by the user via the user interface 70. In one aspect of this disclosure, the controller 64 may automatically populate the second desired preset blade orientation to be substantially opposite the first desired preset blade orientation to allow the motor grader 10 to execute the S-like grading function described above. Further still, in another aspect of this disclosure the user interface 70 may provide suggestions for common first and second desired preset values that can be selective by the user, saving the user's time by automatically selecting the corresponding circle rotate angle, cross slope angle, and side shift offset distance that correspond with the suggestion.

Next, the user may move the circle rotate position roller twice in the first direction within the time threshold to indicate the user wants to orient the blade in the first desired preset blade orientation. The controller 64 may then utilize the positioning system 66 as described above to position the blade in the threshold locations established for the first desired preset blade orientation. Once the blade 46 is in the first desired preset blade orientation, the user may execute a first pass on a starting side of a work plane while the blade 46 manipulates debris of the underlying surface towards an end side of the work plane. As the user executes the first pass, the user may selectively alter the circle rotate angle $\alpha$, the side shift offset, or the cross slope angle to address different conditions of the underlying surface encountered during the first pass. Once the user reaches an ending point of the first pass, the user may raise the blade 46 and turn the motor grader 10 substantially 180 degrees to perform an adjacent second pass in the opposite direction.

Once the user positions the motor grader 10 in a location substantially adjacent the first pass towards the end side, the user may move the circle rotate position roller twice in the second direction within the time threshold to indicate the user wants to orient the blade in the second desired preset blade orientation. The controller 64 may then utilize the positioning system 66 as described above to position the blade in the threshold locations established for the second desired preset blade orientation regardless of the blade position when the user finished the first pass. Once the blade 46 is in the second desired preset blade orientation, the user may execute a second pass at a location next to the first pass towards the end side and in an opposite direction of the first pass.

While executing the second pass, the blade 46 manipulates debris of the underlying surface towards an end side of the work plane. As the user executes the second pass, the user may selectively alter the circle rotate angle $\alpha$, the side shift offset, or the cross slope angle to address different conditions of the underlying surface encountered during the second pass. Once the user reaches an ending point of the second pass, the user may raise the blade 46 and turn the motor grader 10 substantially 180 degrees to perform an adjacent third pass in the opposite direction. Prior to executing the third pass, the user may orient the blade in the first desired preset blade orientation similar to the first pass.

A person skilled in the art understands that the user will selectively orient the blade alternatively between the first and second desired preset blade orientations until they have covered the entire work plane. Further, establishing consistent starting orientations for the blade 46 during each pass allows the user to similarly work the underlying surface during each pass, regardless of how the subsequent pass ended. Accordingly the teachings of this disclosure allow a user to quickly and consistently grade the work plane.

While embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A work machine, comprising:

a blade that is positionable at a plurality of angles relative to the work machine;

a positioning system coupled to the blade to transition the blade to any one of the plurality of angles;

a user interface providing a user input, wherein the user input has a first direction and a second direction; and a controller in communication with the positioning system and the user input;

wherein, when the controller receives a first user input signal from the user interface in response to the user input moving twice along the first direction, the controller positions the blade in a first preset position with the positioning system and wherein, when the controller receives a second user input signal from the user interface in response to the user input moving twice along the second direction, the controller positions the blade in a second preset position with the positioning system.

2. The work machine of claim 1, further wherein the positioning system comprises a circle rotate sensor that communicates with the controller to identify a current angle of the blade relative to the work machine.

3. The work machine of claim 2, further wherein the controller monitors work machine sensors other than the circle rotate sensor of the work machine to identify a conflict before the controller moves the blade to the first preset position.

4. The work machine of claim 3, further wherein the controller issues a warning when the controller identifies the conflict.

5. The work machine of claim 3, further wherein the controller does not position the blade in a first preset position with the positioning system if the controller identifies the conflict.

6. The work machine of claim 1, further wherein the user interface selectably provides the second user input signal to the controller and the controller positions the blade in the second preset position with the positioning system responsive to the second user input signal.

7. The work machine of claim 6, further wherein the first preset position angle angles the blade to a first side of the work machine and the second preset position angle angles the blade to a second side of the work machine.

8. The work machine of claim 7, further wherein the first preset position angle and the second preset position angle are substantially mirrored angles about a longitudinal axis of the work machine.

9. The work machine of claim 6, further wherein the user input is a roller having a first direction and a second direction and moving the roller twice in the first direction sends the first user input signal and moving the roller twice in the second direction sends the second user input signal.

10. A method for controlling the blade position of a work machine, comprising:

providing a controller, a blade movably coupled to the work machine, a user interface having a user input, and a positioning system coupled to the blade to reposition the blade relative to the work machine;

storing in the controller, a first preset position and a second preset position of the positioning system;

identifying, with the controller through the user interface, a first input signal when the user interface is engaged by the user input manipulated twice in a first direction;

positioning the blade, with the controller through the positioning system, to the first preset position when the controller identifies the first input signal;

identifying, with the controller through the user interface, a second input signal when the user interface is engaged by the user input manipulated twice in a second direction;

positioning the blade, with the controller through the positioning system, to the second preset position when the controller identifies the second input signal.

11. The method of claim 10, further wherein the controller monitors one or more position sensors of the positioning system to identify a current angle of the blade, wherein, the controller repositions the blade until the current angle is a first preset angle of the first preset position.

12. The method of claim 11, wherein the controller monitors work machine sensors other than the one or more position sensors and establishes a maximum first preset position based on the work machine sensors other than the one or more position sensors.

13. The method of claim 10 wherein the first preset position and the second preset position are substantially mirror images of the blade position.

14. The method of claim 13, wherein the first input signal is a double button press of the user interface in a first direction over a time threshold and the second input signal is a double button press of the user interface in a second direction over the time threshold.

15. The method of claim 13, further wherein the first preset position and the second preset position are selectable by the user from a plurality of preset position options through the user interface.

16. The method of claim 13, wherein the first preset position biases the blade to move underlying debris to a first side of the work machine and the second preset position biases the blade to move underlying debris to a second side of the work machine.

17. A motor grader system, comprising:

a rear frame section;

a front frame section coupled to the rear frame section;

an engine coupled to the rear frame section;

a circle rotate assembly coupled to the front frame section;

a blade rotationally coupled to the circle rotate assembly to selectively alter a blade angle relative to a longitudinal axis;

a user interface having one or more user input options; and a controller in communication with the circle rotate assembly to alter the blade angle responsive to a user input;

wherein, one of the user input options is a first input movable in a first direction that correlates with a first preset blade angle and the controller positions the blade angle to be the first preset blade angle responsive to the first input;

further wherein one of the user input options is a second input moveable in a second direction that correlates with a second preset blade angle and the controller positions the blade angle to be the second preset blade angle responsive to the second input;

wherein movement of the second input twice within a time threshold, while the blade angle is the first preset blade angle, moves the blade angle from the first preset blade angle to the second preset blade angle;

wherein the first preset blade angle and the second preset blade angle are substantially mirror images about a longitudinal axis of the motor grader system.

18. The motor grader system of claim 17, further wherein the first preset blade angle and the second preset blade angle are substantially mirror images about a longitudinal axis of the motor grader system.

19. The motor grader system of claim 17, further wherein a circle rotate sensor is monitored by the controller to identify the blade angle.

20. The motor grader system of claim 19, further comprising one or more wheels coupled to each of the front frame section and the rear frame section, wherein the controller monitors the work machine sensors other than the circle rotate sensor of the motor grader system to identify the position of the rear frame section and any wheel coupled thereto relative to the front frame section and does not allow the first preset blade angle or the second preset blade angle to be a blade angle that would cause contact between the blade and the front or rear frame sections or the one or more wheels coupled thereto.

* * * * *